US007106219B2

(12) United States Patent
Pearce

(10) Patent No.: US 7,106,219 B2
(45) Date of Patent: Sep. 12, 2006

(54) DECENTRALIZED VEHICULAR TRAFFIC STATUS SYSTEM

(76) Inventor: James W. Pearce, 254 Babbs Rd., Lenoir City, TN (US) 37771

( * ) Notice: Subject to any disclaimer, the term of this patent is extended or adjusted under 35 U.S.C. 154(b) by 99 days.

(21) Appl. No.: 10/704,040

(22) Filed: Nov. 7, 2003

(65) Prior Publication Data

US 2005/0099321 A1 May 12, 2005

(51) Int. Cl.
*G08G 1/123* (2006.01)

(52) U.S. Cl. ..... 340/995.13; 340/934; 382/104; 701/213

(58) Field of Classification Search ..... 340/98–996; 382/104; 348/149; 701/213–216, 300–302
See application file for complete search history.

(56) References Cited

U.S. PATENT DOCUMENTS 4,063,073 A 12/1977 Strayer
5,389,934 A 2/1995 Kass
5,543,789 A 8/1996 Behr et al.
6,204,808 B1 * 3/2001 Bloebaum et al. ..... 342/357.07
6,314,366 B1 11/2001 Farmakis et al.
6,480,121 B1 11/2002 Reimann
6,487,500 B1 11/2002 Lemelson et al.
6,564,149 B1 5/2003 Lai
6,580,909 B1 6/2003 Carro
6,611,755 B1 * 8/2003 Coffee et al. ..... 701/213
6,848,657 B1 * 2/2005 Young et al. ..... 246/1 R
2001/0037174 A1 * 11/2001 Dickerson ..... 701/200
2005/0083211 A1 * 4/2005 Shafir et al. ..... 340/905
2005/0088318 A1 * 4/2005 Liu et al. ..... 340/902

* cited by examiner

*Primary Examiner*—Daniel Wu
*Assistant Examiner*—George Bugg
(74) *Attorney, Agent, or Firm*—Pitts & Brittian, P.C.

(57) ABSTRACT

A decentralized, mobile system for reporting and monitoring vehicular traffic status. A vehicle has a position determining device, a transceiver, and a local display and controller connected to a processor. The transceiver receives, transmits, and repeats local traffic and vehicle information, such as location, direction, and speed. The processor is programmed to execute processes including receiving messages, repeating received messages, transmitting messages, reporting vehicle data through a vehicle message, and displaying traffic status information based on the received data.

42 Claims, 6 Drawing Sheets

DECENTRALIZED VEHICULAR TRAFFIC STATUS SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a system for reporting and monitoring vehicular traffic status. More particularly, this invention pertains to transceivers in vehicles that receive, transmit, and repeat local traffic and vehicle information. Traffic status is determined by decentralized processing.

2. Description of the Related Art

Portable communications devices offer many services, including access to the global positioning system (GPS), access to the internet, and cameras, both still and video. Many of these portable communications devices are built into vehicles.

U.S. Pat. No. 6,480,121, titled "Comprehensive information and service providing system," issued to Reimann on Nov. 12, 2002, discloses a system that provides services to mobile units, including weather information, Internet access, and police and emergency services. Reimann further discloses displaying traffic status maps provided by a central service provider 46, who collects and compiles the traffic data.

U.S. Pat. No. 6,580,909, titled "Communications System and Method Based on the Relative Positions of Mobile Units," and issued to Carro on Jun. 17, 2003 discloses a network of mobile communications units. Carro discloses peer-to-peer wireless communications enabled between mobile communications units so that a fleet of mobile units form a meshed network that does not require a base station to operate.

BRIEF SUMMARY OF THE INVENTION

According to one embodiment of the present invention, a decentralized, mobile system for reporting and monitoring vehicular traffic status is provided. A vehicle has a position determining device, a transceiver, and a local display and controller connected to a processor. The transceiver receives, transmits, and repeats local traffic and vehicle information, such as location, direction, and speed, with other vehicles having a transceiver. The processor determines local traffic conditions based on the received data.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A decentralized, mobile system for reporting and monitoring vehicular traffic status is disclosed.

The system relies on messages sent by each participating vehicle 102. A participating vehicle is one that contains a mobile traffic unit 10 that is operational. The mobile traffic unit 10 in each vehicle 102 broadcasts that vehicle's location and speed information. By processing the data that is received from vehicles 102 that are on the same roads and going the same direction, the unit can display traffic information, including indications that the traffic has slowed far below the normal speed limit for that particular route.

Figure 1:
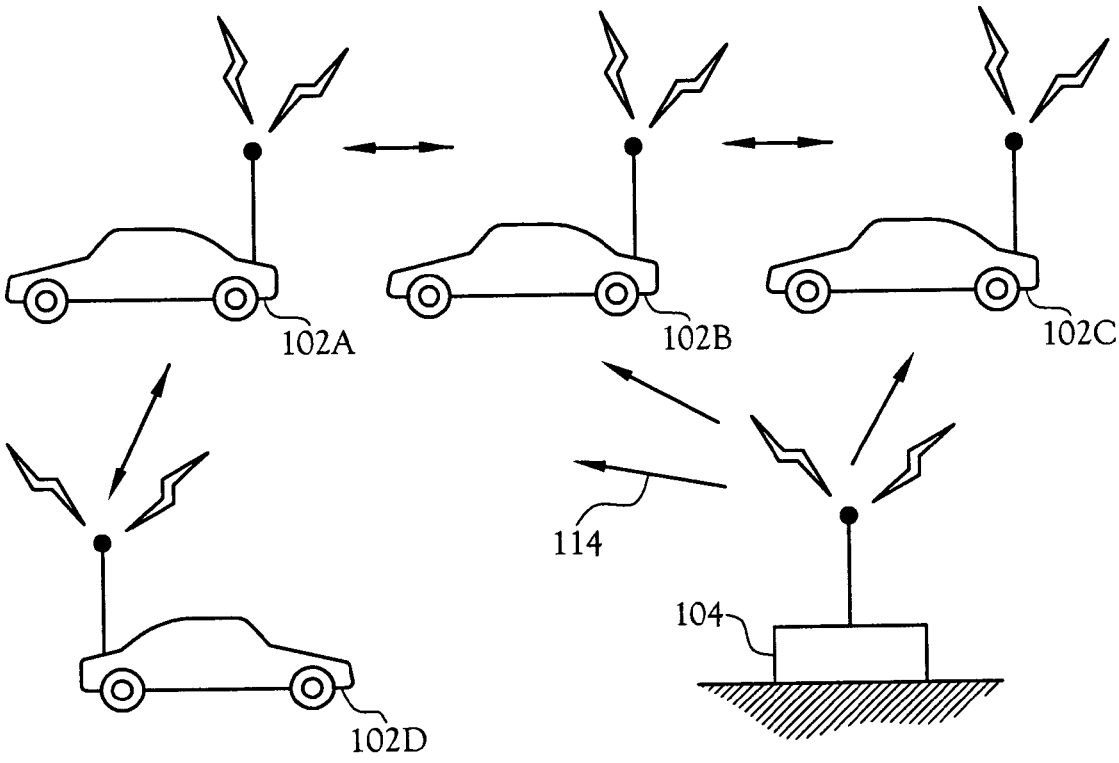
FIG. 1 is a pictorial view of one embodiment of a mobile traffic system.

FIG. 1 illustrates several vehicles 102 communicating with other vehicles 102 and a fixed base station 104. In the illustrated embodiment, each vehicle 102 communicates with each vehicle 102 within a small radius limited by the power of the vehicle's transmitter. When a vehicle 102A receives a message 114, the vehicle 102C repeats that message to vehicles 102B within range, and those vehicles 102B repeat to other vehicles 102A, provided the other vehicles 102A are within a specified area. The base station 104 transmits, via radio frequency signals 114, a traffic notice of unsafe or unusual traffic conditions.

Figure 2:
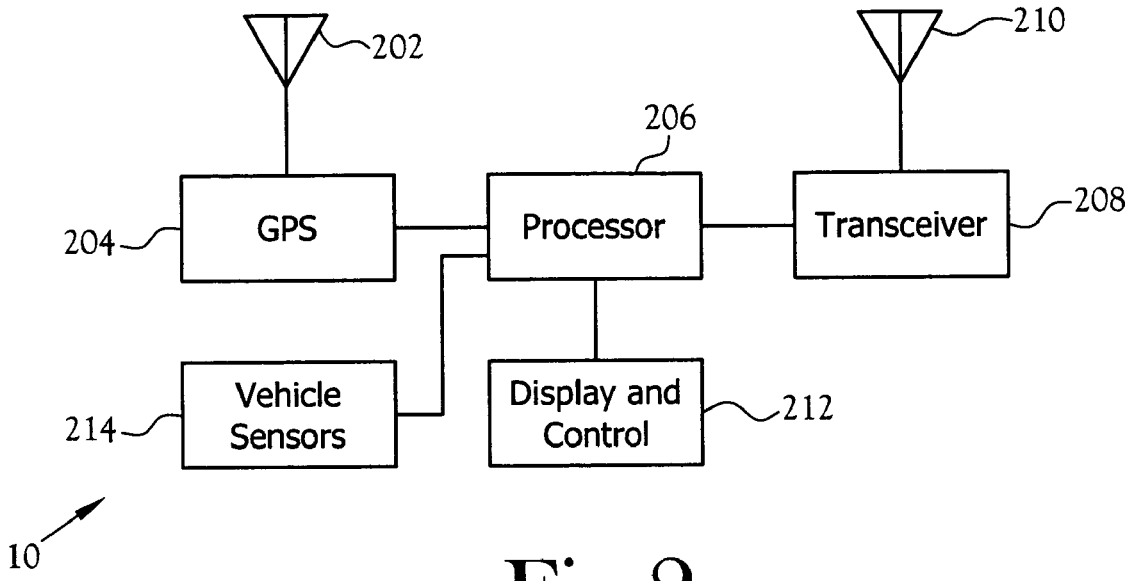
FIG. 2 is a block diagram of one embodiment of a mobile traffic unit.

FIG. 2 illustrates a block diagram of mobile traffic unit 10 carried by a single vehicle 102. A position determining device, such as a global positioning system (GPS) receiver 204 connected to an antenna 202, communicates with a processor 206. Connected to the processor 206 is a transceiver 208 with an antenna 210, a display and control unit 212, and vehicle sensors 214. In the illustrated embodiment, the display and control unit 212 is a single device that provides a display to the user and allows interaction between the user and the processor 206. In another embodiment, the functions performed by the display and control unit 212 are performed by a separate display unit and a separate control unit, both communicating with the processor 206. In the illustrated embodiment, the transceiver 208 is a single device that both transmits and receives. In another embodiment, the functions performed by the transceiver 208 are performed by a separate transmitter and receiver.

The vehicle information, in the illustrated embodiment, is gathered from the position determining device, or global positioning system receiver, 204 and the vehicle sensors 214. The GPS provides the location of the vehicle and the time and date, and the vehicle sensors 214 provide information regarding the vehicle speed and direction of travel. In another embodiment, the GPS 204, in combination with the processor 206, provides the location of the vehicle, the vehicle speed, the direction of travel, and the time and date, without resort to the vehicle sensors 214. The speed and direction of travel is determined by comparing multiple readings from the GPS 204 to determine the distance traveled for a period of time and the direction of travel over that time.

The processor 206 should be broadly construed to mean any computer or component thereof that executes software. In one embodiment the processor 206 is a general purpose computer, in another embodiment, it is a specialized device for implementing the functions of the invention. Those skilled in the art will recognize that the processor 206 includes an input component, an output component, a storage component, and a processing component. The input component receives input from external devices, such as the position determining device 204 and the transceiver 208. The output component sends output to external devices, such as the transceiver 208 and the display and control unit 212. The storage component stores data and program code. In one embodiment, the storage component includes random access memory. In another embodiment, the storage component includes non-volatile memory, such as floppy disks, hard disks, and writeable optical disks. Those skilled in the art will recognize that the components associated with the processor 206 can be either internal or external to the processing unit of the processor 206 without departing from the scope and spirit of the present invention. The processing component executes the instructions included in the software and routines. Those skilled in the art will recognize that it is possible to program a general-purpose computer or a specialized device to implement the invention.

The transceiver 208 receives, transmits, and repeats local traffic and vehicle information, including location, direction, and speed, with other vehicles 102 having a mobile traffic unit 10. In the illustrated embodiment, each mobile traffic unit 10 is equipped with a digital data radio frequency (RF) transceiver 208 that transmits and receives packets. Those skilled in the art will recognize that individual transmitters and receivers can be used without departing from the spirit and scope of the present invention. The transceiver 208, in one embodiment, has a low transmit power of approx 0.25 Watts. Such a low power transceiver 208 is insufficient for communicating over more than one mile. In order for the system to send a particular packet farther than this, each vehicle acts as a repeater of the packets that it receives. The communication protocol for one embodiment of the mobile traffic unit 10 consists of frequency shift keying (FSK) digital modulation using a single RF carrier center frequency. At a data rate of 1 megabit per second, each packet will take 180 microseconds to transmit.

Transmission and reception of packets may occur on one or more frequencies or codes in cases where code-division multiple access (CDMA) is used as the RF communication protocol. The packets are sent at a preselected interval by each vehicle. The transmission of each vehicle's information is on a single frequency and/or code. In one embodiment, the packet includes a 32 bit preamble, 5 bits indicating the packet type, 3 bits indicating vehicle type, 16 bits for the repeat count, a 32 bit unique originator ID, a 16 bit packet sequential ID, 32 bits for the time and date of packet origination (to the nearest second), 16 bits for the road in use, 4 bits for the direction of travel, 8 bits for the speed of the vehicle 102, and 16 bits for the CRC, for a total packet size of 180 bits, not including the preamble.

The preamble is a repetitive pattern that is easily distinguished by a receiver. Typically, this is an alternating 0, 1 pattern for 28 bits while the last 4 bits are 0, 0, 1, 1. The packet type field indicates whether the packet is from a moving vehicle 102, an emergency vehicle, or a fixed traffic warning. The field has additional bits to allow for future expansion of capabilities. The vehicle type field indicates the class of the vehicle 102 reporting its speed. This is provided because a traffic problem for one class of vehicle 102 such as large trucks may not cause a problem for other classes of vehicles 102. A motorcycle may maneuver around backed-up traffic and report an abnormally high speed. In one embodiment, this report is ignored by other classes of vehicles 102. The repeat count indicates how many times a packet has been forwarded by a mobile traffic unit 10. The generating mobile traffic unit 10 sends its own packets out with this field set to zero. When a packet is repeated by a mobile traffic unit 10, this field is incremented by 1. This field (and the CRC field) is the only field that is modified by a mobile traffic unit 10 when it repeats a packet.

The unique originator ID is a distinguishing number that allows packets from a particular vehicle 102 to be identified. For privacy protection this number changes every time the mobile traffic unit 10 is enabled. A system that continuously broadcasts a motorist's position and speed will be resisted by the market place unless methods of making the data anonymous are employed. In one embodiment, anonymous data is provided by the mobile traffic unit 10 selecting a fresh unique originator ID for the packets every time the vehicle is started. In one embodiment, this unique originator ID number is selected by a random number generator using a combination of the vehicle's VIN number and the time of day of power up as the seed for a random number generator. In another embodiment, privacy protection is accomplished by a power switch on the display and control unit 212 that allows the user to completely disable the operation of the system.

The packet sequential ID field indicates a sequential serial number of the packet that the mobile traffic unit 10 generates. Each time a vehicle 102 is started, this field is reset to zero. Each subsequent packet that the mobile traffic unit 10 generates has the value of this field incremented. The time and date of packet origination field is used to time stamp a packet. In one embodiment, the time and date are derived from the GPS data and are sent as UTC (GMT). The road in use field indicates the specific highway or road on which the vehicle is traveling 102. A special code is reserved for cases where the mobile traffic unit 10 cannot identify the road in use. The direction of travel field indicates in which lane the vehicle 102 is traveling.

The speed field indicates the speed of the vehicle 102. In one embodiment, the reported speed is capped at the speed limit for the road in use at the vehicle's location. This prevents the "self incrimination" that would occur if the mobile traffic unit 10 reported a speed over the speed limit. Such a cap has no adverse impact on the system since it is intended to warn of congested, low-speed situations.

The CRC field is the "Cyclic Redundancy Check" and allows a receiver to determine if the packet was received with no errors. If errors were received, the packet is discarded.

Figure 3:
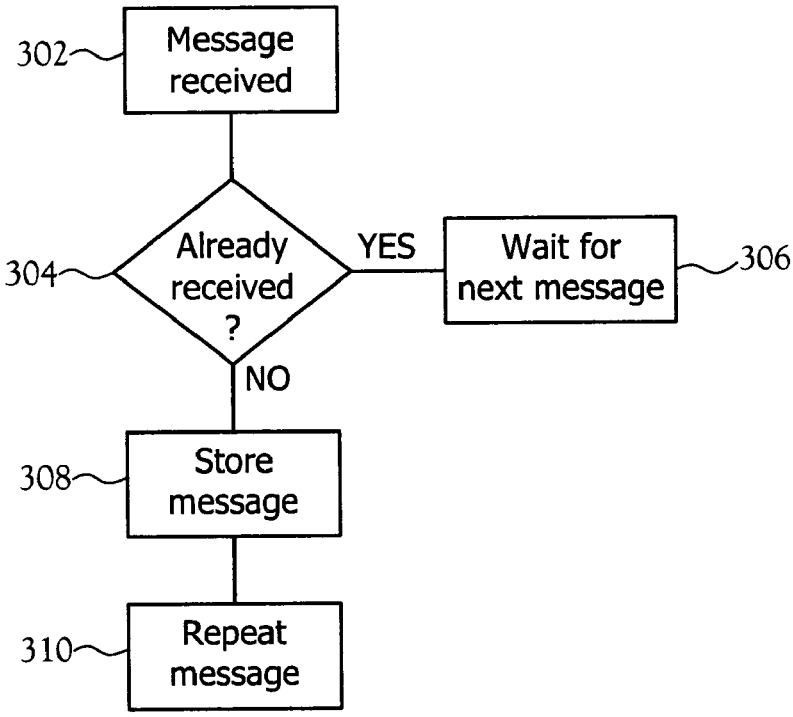
FIG. 3 is a flow diagram of one embodiment of a process for handling received messages.

FIG. 3 illustrates one embodiment of the process for handling received messages. The first step is receiving the message 302 by the transceiver 208. The message is examined to determine if the message has already been received 304. If the message has already been received, the process waits for the next message 306. In one embodiment, the process loops, continually checking for messages. If the received message has not already been received, the message is stored 308. The message is then processed through the repeat message step 310.

As the local mobile traffic unit 10 receives packets from other vehicles 102 it maintains a database that builds a picture of the condition of traffic flow within various segments of each road for which it receives data. The database contains the location and average speed of each vehicle 102 that is traversing these road segments. In one embodiment, as part of storing the message 308, the database is resorted after the message is placed in the database. The step of storing the message 308, in another embodiment, includes the step of scanning the messages contained in the database to identify and delete messages that have expired, or are obsolete. Expired messages are those that are older than a specified age. In another embodiment, the removal of expired, or obsolete, messages is performed as an independent process outside the process illustrated in FIG. 3. In another embodiment, the messages in the database are resorted after removal of the expired messages. In still another embodiment, the database is packed to remove the unused storage space previously occupied by the expired messages.

Figure 4:
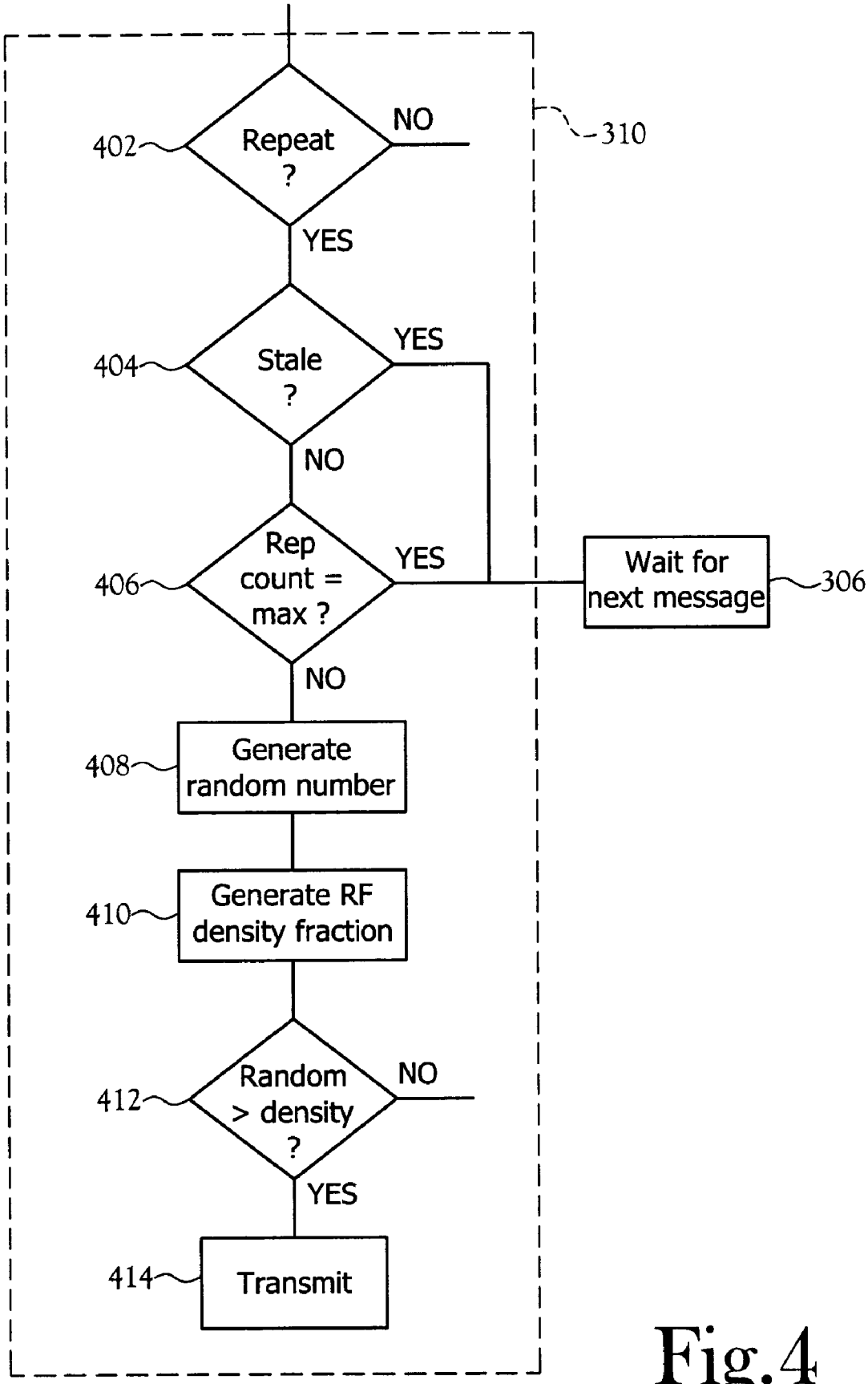
FIG. 4 is a flow diagram of one embodiment of a process for repeating messages.

FIG. 4 illustrates one embodiment of the process for repeating the message 310. The first step is to determine whether the message is to be repeated 402. A set of rules are applied to the message to determine whether it is to be repeated. Several of the rules are shown in FIG. 4 for illustration and discussed below.

If the message is not to be repeated, the process stops. If the message is to be repeated, the message is examined to determine if it is stale 404. In one embodiment, a packet is defined as stale if its age, based on the time of its origination, divided by the distance from its origination is greater than 0.1 minutes per mile. If the message is stale, the process waits for the next message 306. If the message is not stale, the repetition count is examined to determine if it equals or exceeds the maximum packet repetition count 406. If the maximum packet repetition count has been reached, the process waits for the next message 306. If not, a random number is generated 408 and the local traffic RF density is generated 410. The random number is compared to the local traffic RF density 412. If the random number is larger, the process stops. If the local traffic RF density is larger, then the message is transmitted 414.

Figure 5:
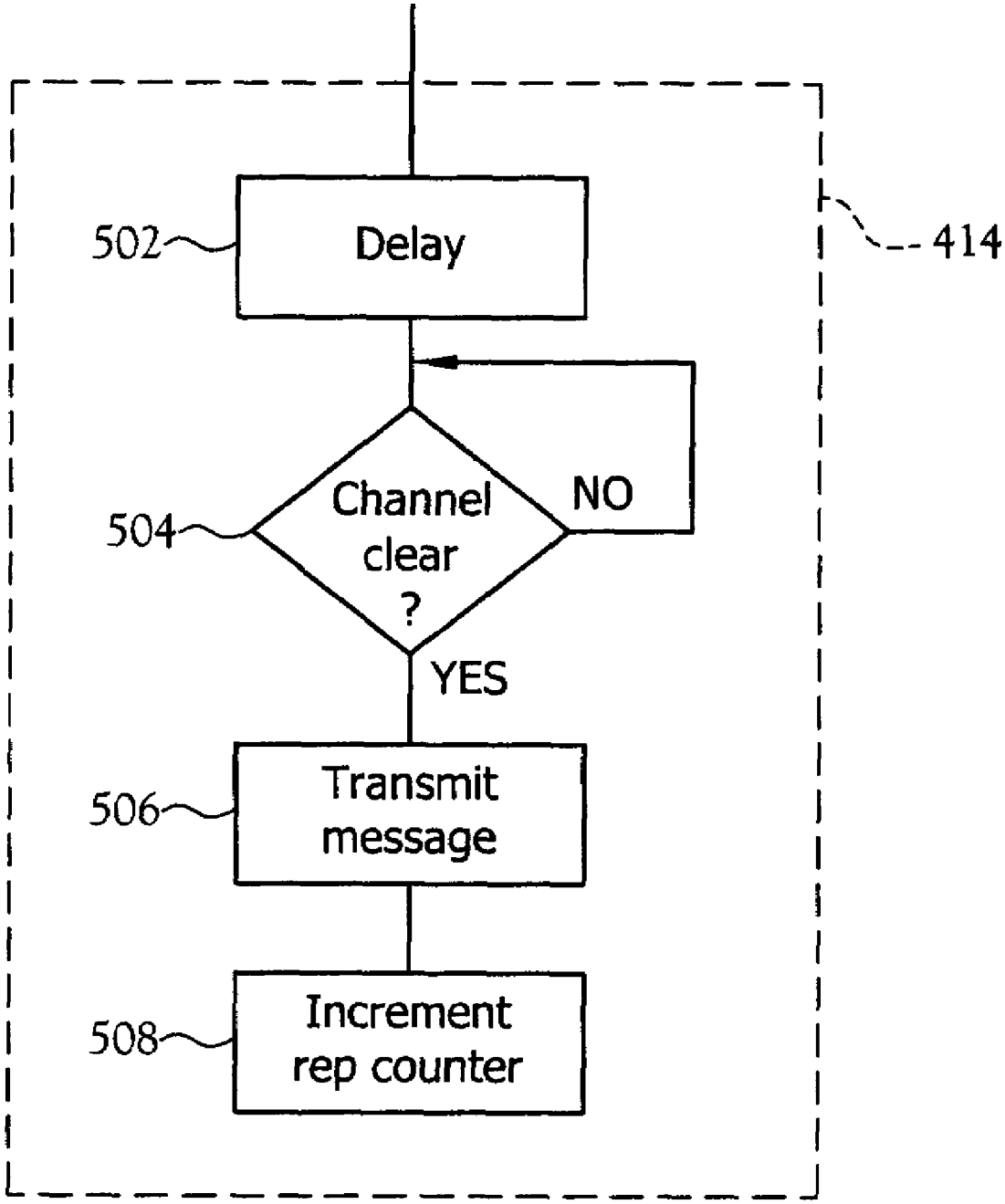
FIG. 5 is a flow diagram of one embodiment of a process for transmitting messages.

FIG. 5 illustrates one embodiment of transmitting the message 414. In the illustrated embodiment, the process waits for a period equal to a random delay 502. In another embodiment, the delay 502 is not implemented. The channel is then checked to see if it is clear 504. If not, the channel is repeatedly checked 504 until it is clear. When the channel is clear 504, the message is transmitted 506 and the packet repetition count is incremented 508.

FIGS. 3 and 4 illustrate one embodiment of the repeating process. Messages, or packets, are propagated beyond the range of a single transceiver 208 by the transceivers 208 located in other vehicle's mobile traffic units 10. The illustrated embodiment shows repeating using a "store and forward" concept as opposed to simultaneous, real-time repeating. This means that the rebroadcast of a packet only occurs after the entire packet has been received and verified to be error free. The repeating process is governed by a set of rules that prevents the RF channel from becoming congested. When not transmitting its own information, each vehicle 108 is continuously listening to one of more channels for packets from other vehicles 108.

After receiving a packet, the process applies a set of rules to the packet to decide whether to repeat it 310. In various embodiments, the following rules are applied:

1. If the packet originated from the receiving mobile traffic unit 10, never repeat it.

2. If the packet has a flag indicating that it should not be repeated, never repeat it.

3. If the packet is "stale," never repeat it.

4. If the packet has already been repeated, do not repeat it again.

5. If the maximum packet repetition count is exceeded for a packet, do not repeat it.

6. If the packet originated from a great distance (>500 ml), decrease the probability that it be repeated.

7. If the local traffic RF density is very heavy, only allow packets that originated from the direction in which the mobile traffic unit 10 is traveling to be repeated.

8. If a packet is received with a repeat count that is higher than the count of the packet that was received previously (indicating that another mobile traffic unit 10 within range has already repeated it), do not repeat it 9. If none of the above conditions are met, repeat the packet using a probability that is based on the local traffic RF density.

The local mobile traffic unit 10 can determine the local traffic RF density by measuring the number of packets that it receives within a given interval that have a repeat count of zero, indicating that the packet originated from a mobile traffic unit 10 within the range of direct RF communication.

The interval that a vehicle sends its packet is based on the local traffic RF density and the driving conditions of that vehicle. In light traffic when the vehicle is traveling at the speed limit for the road that it is using, in one embodiment, the packets will be broadcast at a rate of approximately three per minute. If the vehicle is in heavy traffic the reporting will be slowed to as low as one packet per minute. In another embodiment, the packet origination frequency is based on distance traveled. In this embodiment, the packets are generated no less frequently than four per mile. In slow driving conditions the packets are originated no less frequently than one per minute.

Figure 6:
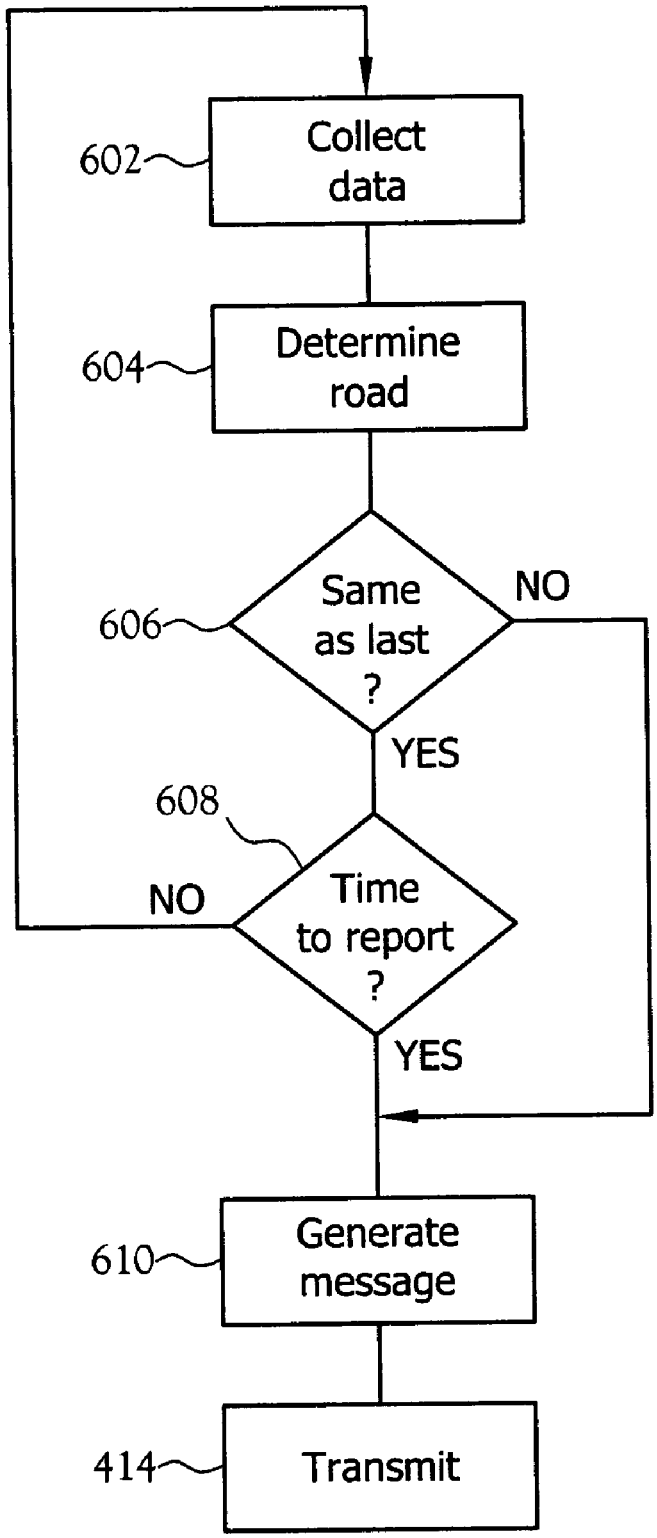
FIG. 6 is a flow diagram of one embodiment of a process for reporting location information.

FIG. 6 illustrates one embodiment of a process for reporting location information. The local mobile traffic unit 10 continually collects data 602. In one embodiment, the processor 206 polls the position determining device at specified intervals. In various embodiments, the collected data includes vehicle location information, vehicle speed, vehicle direction, time, and date. In one embodiment, the data is collected 602 by a GPS unit 204 that determines a vehicle location, time, and date. The vehicle location information is processed to determine the road 604 on which the vehicle 102 is traveling.

The location is compared to the last location reported 606, and if the location is on the same road, the current time is compared to the time of the last reported location to determine if it is time to report 608. If it is not time to report 608, the process returns to the collect data step 602. If the vehicle 102 is located on a different road, the time to report 608 test is skipped. If the location information is to be reported, the message is generated 610 and then transmitted 414.

Figure 7:
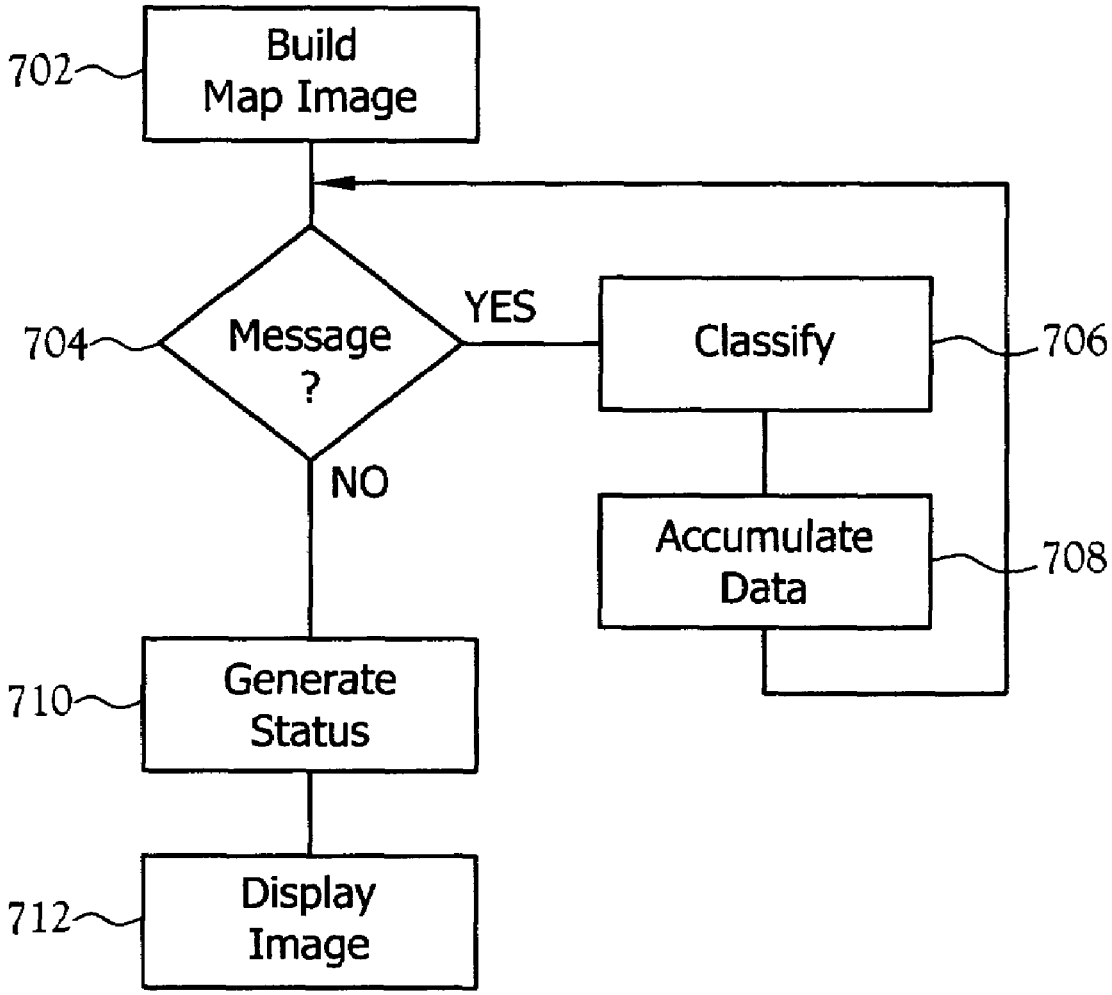
FIG. 7 is a flow diagram of one embodiment of a process for displaying traffic information.

FIG. 7 illustrates one embodiment of a process for displaying traffic information. The first step is to build a map image 702 based on the current position of the vehicle 102. The next step is to scan the message data to determine if there are any messages from other vehicles 102 within the area of the map image. If such a message is found, the message is classified 706 with respect to speed and location. The speed and location data is accumulated 708 and the next message is located. This sub-process repeats for every message from other vehicles 102 within the area of the map image. After all the messages are processed, the next step is to generate the status 710 to overlay over the map image. The final step is to display the composite map image 712 on a display unit 212 in the vehicle 102. The map image is displayed to a preselected scale.

The display and control unit 212, in one embodiment, includes a user interface allowing the user to control the image scale, that is, the user can zoom the map image to a larger or smaller scale, thereby increasing the area displayed or increasing the visible detail by showing an image with less area. If the scale is increased, the process illustrated in FIG. 7 is repeated to capture messages not originally imaged. If the scale is decreased, the display image step 712 is repeated for the desired scale.

The map image, in one embodiment, includes a graphical depiction of the roads and landmarks for a specified area surrounding the vehicle 102. The status information showing the traffic conditions is to overlay the generated status 710 data over the map image to form a composite map image. Traffic is determined by the vehicles 102 reporting vehicle information through a mobile traffic unit 10. The traffic status, in one embodiment, is presented by showing road segments in a specified color. Traffic that is flowing normally is indicated by road segments shown in green. Traffic that is slowed to a fraction of the speed limit are shown as yellow. When traffic is slowed to a stand-still the location of the slow traffic is shown in red or another suitable color. For example, road segments over which at least 90% of the traffic is moving at the speed limit are shown in green. Road segments over which more than 50% of the traffic is moving at 10 to 25 miles per hour less than the speed limit are shown in yellow. Road segments over which more than 50% of the traffic is moving at 0 to 20 miles per hour are shown in red, and road segments over which more than 90% of the traffic is moving at 0 to 5 miles per hour are shown in magenta. In various embodiments, the specific colors, speeds, and percentages for displaying status information are controlled by the user through the display and control unit 212 and the processor 206, which includes software allowing the user to specify custom colors and features.

The traffic status includes unsafe or unusual traffic conditions sent by a base station 104. This information is reported via the display and control unit 212 in such a manner that the location and urgency of the message is indicated.

In another embodiment, instead of a composite map image, the display and control unit 212 indicates the traffic status of the vehicles' current location by a colored indicator, using such colors as indicated above for traffic conditions. In still another embodiment, the display and control unit 212 indicates the traffic status of the vehicles' current location by displaying a textual message. In one embodiment, exemplary messages include "Traffic OK," "Slow Traffic ahead," "Traffic Slows in 2.2 miles," and "Traffic Stopped." In various embodiments, the display and control unit 212 indicates the traffic status of the vehicles' current location through a combination of a display of a composite map image, colored indicators, textual messages and/or verbal messages.

In one embodiment, each of the functions identified in above are performed by one or more software routines run by the processor 206. In another embodiment, one or more of the identified functions are performed by hardware and the remainder of the functions are performed by one or more software routines run by the processor 206. In still another embodiment, the functions are implemented with hardware, with the processor 206 providing routing and control of the entire integrated system 10.

The processor 206 executes software, or routines, for performing various functions. These routines can be discrete units of code or interrelated among themselves. Those skilled in the art will recognize that the various functions can be implemented as individual routines, or code snippets, or in various groupings without departing from the spirit and scope of the present invention. As used herein, software and routines are synonymous. However, in general, a routine refers to code that performs a specified function, whereas software is a more general term that may include more than one routines or perform more than one function.

The processor 206 is programmed to execute various processes. These processes require communication with other components. Those skilled in the art will recognize that additional sub-processes can be utilized without departing from the spirit and scope of the present invention. The performance of these processes, in combination with the other components of the mobile traffic unit 10, forms a method of operation.

One such process is illustrated in FIG. 3, which is one embodiment of a process for receiving messages from other mobile traffic units 10. This process communicates with the receiver portion of the transceiver 208 to receive a message 302. This process includes sub-processes for determining whether the message has already been received 304, storing the message 308, and communicating with the process for repeating messages 310.

Another such process is illustrated in FIG. 4, which is one embodiment of a process for repeating received messages 310. This process includes determining whether to repeat a received message. If this process determines that a message is to be repeated 402, the process prepares the message for repeating and provides a message for repeating to the process for transmitting messages 414. This process includes the sub-processes for determining if the message is stale 404, determining if the repetition count exceeds the maximum packet repetition count 406, generating a random number 408 and a local traffic RF density 410, and comparing the results 412 to determine if the message is to be repeated.

Another such process is illustrated in FIG. 5 which is one embodiment of a process for transmitting messages 414. This process provides for transmitting both received messages to be repeated and messages originating from the transmitting mobile traffic unit 10. The process for transmitting messages includes the processor 206 communicating with the transceiver 208 to determine if the receiver detects a clear channel 504 and to send the message to the transmitter 506. In one embodiment, this process increments a packet repetition counter 508. In another embodiment, the process delays 502 before performing the other sub-processes.

Another such process is illustrated in FIG. 6, which is one embodiment of a process for reporting vehicle data through a vehicle message. This process includes the sub-processes of constructing a message containing vehicle data and communicating with the process for transmitting messages. The process for constructing a message includes the sub-processes of acquiring, or collecting, data 602, determining the road 604 from the location information provided by the position determining device 204, determining whether the location 606 and time 608 are sufficiently different to generate a message, and generating the message 610 to be transmitted.

Another such process is illustrated in FIG. 7, which is one embodiment of a process for displaying traffic status information. This process includes the sub-processes for generating the information to be displayed and communicating that information to the display and control unit 212. In one embodiment, this process builds a composite map image showing traffic status and communicates with the display and control unit 212 for displaying the composite map image 712. This process includes the sub-processes of building a map image 702, scanning a database of received messages 704, classifying 706 and accumulating 708 traffic data, and generating status information 710.

The decentralized, mobile system for reporting and monitoring vehicular traffic status includes various functions. The function of acquiring vehicle data is implemented, in one embodiment, by the position determining device, or global positioning system receiver, 204 and the vehicle sensors 214. In another embodiment, the function of determining vehicle data is implemented by the GPS 204 in combination with the processor 206. In this embodiment, the processor 206 determines the speed and direction of travel by comparing multiple readings from the GPS 204 to determine the distance traveled for a period of time and the direction of travel over that time.

The function of transmitting vehicle data is implemented, in one embodiment, by the transceiver 208 and the processor 206. In another embodiment, the function of transmitting vehicle data is implemented by a separate transmitter. In both embodiments, the processor 206 executes software for reporting vehicle data through a vehicle message, repeating received messages, and transmitting the transmitted message. The function of receiving a received message from a plurality of other vehicles is implemented, in one embodiment, by the transceiver 208 and the processor 206. In another embodiment, the function of receiving a message from a plurality of other vehicles is implemented by a separate receiver. In both embodiments, the processor 206 executes software for receiving said received message.

The function of repeating a received message from other vehicles is implemented, in one embodiment, by the transceiver 208 and the processor 206. In another embodiment, the function of repeating a received message from other vehicles is implemented by a separate receiver. In both embodiments, the processor 206 executes software for repeating a received message.

The function of displaying traffic status information is performed by the processor 206 and the display unit 212. The processor 206 executes software for displaying traffic status information. The function of disabling the mobile traffic unit 10 is performed by a power switch on the display and control unit 212 that allows the user to completely disable the operation of the system. The function of preventing self-incrimination is performed by capping the reported speed in the vehicle message to the speed limit for the road in use at the vehicle's location.

From the foregoing description, it will be recognized by those skilled in the art that a decentralized, mobile system for reporting and monitoring vehicular traffic status has been provided. The system includes several mobile traffic units located within a specific area. Each mobile traffic unit includes a position determining device, such as a global positioning system receiver, connected to a processor, which is connected to a transceiver for communicating with other mobile traffic units. The mobile traffic unit also includes a display and control unit connected to the processor for interacting with the user in the vehicle.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

I claim:

1. A mobile traffic unit for reporting and monitoring vehicular traffic status, comprising:

a position determining device;

a transmitter for sending a transmitted message;

a receiver for receiving a received message containing a vehicle location, a vehicle speed, a vehicle direction, a vehicle type, a time, and a date;

a display unit presenting traffic status information;

a processor in communication with said position determining device, said transmitter, said receiver, and said display unit, said processor programmed to execute a process including receiving said received message, repeating said received message, transmitting said transmitted message, reporting vehicle data through a vehicle message, and displaying traffic status information, said position determining device, said transmitter, said receiver, said display unit, and said processor located in a vehicle; and a control unit communicating with said processor, said processor programmed to execute a process for customizing attributes of said traffic status information.

2. The mobile traffic unit of claim 1 wherein said vehicle message includes a vehicle location, a vehicle speed, a vehicle direction, a vehicle type, a time, and a date.

3. The mobile traffic unit of claim 1 wherein said vehicle message includes a vehicle location, a vehicle speed, a vehicle direction, a vehicle type, a repeat count, a unique originator identifier, a packet sequential identifier, a time, and a date.

4. The mobile traffic unit of claim 1 wherein said vehicle message includes a vehicle location and a vehicle speed, said vehicle speed capped at a speed limit for said vehicle location.

5. The mobile traffic unit of claim 1 wherein said receiver receives said received message from a base station, said received message containing a traffic notice.

6. The mobile traffic unit of claim 1 wherein said processor is programmed to execute a process for storing said received message in a database.

7. The mobile traffic unit of claim 1 wherein said position determining device includes a global positioning system receiver.

8. The mobile traffic unit of claim 1 wherein said process of receiving said received message includes determining whether said received message has already been received, storing said received message, and communicating with said process for repeating said received message.

9. The mobile traffic unit of claim 1 wherein said process of repeating said received message includes determining if said received message is stale, determining if a repetition count exceeds a maximum packet repetition count, generating a random number and a local traffic RF density, and comparing the results to determine if said received message is to be repeated.

10. The mobile traffic unit of claim 1 wherein said process of transmitting said transmitted message includes determining if there is a clear channel and sending said transmitted message to said transmitter.

11. The mobile traffic unit of claim 1 wherein said process of reporting vehicle data through a vehicle message includes constructing a message containing said vehicle data and communicating with said process for transmitting said transmitted message wherein said transmitted message is said vehicle message.

12. The mobile traffic unit of claim 1 wherein said process of reporting vehicle data through a vehicle message includes acquiring said vehicle data, determining a road from a position determining device, determining whether a location and a time are sufficiently different from a previous location and a previous time to generate said vehicle message, generating said vehicle message to be transmitted, and communicating with said process for transmitting said transmitted message wherein said transmitted message is said vehicle message.

13. The mobile traffic unit of claim 1 wherein said process of displaying said traffic status information includes generating said traffic status information to be displayed and communicating said traffic status information to said display unit.

14. The mobile traffic unit of claim 1 wherein said process of displaying said traffic status information includes building a map image, scanning a database, classifying and accumulating traffic data, and generating said traffic status information as a composite map image.

15. The mobile traffic unit of claim 1 further including a switch for disabling said mobile traffic unit, thereby providing privacy protection for a vehicle driver.

16. A mobile traffic unit for reporting and monitoring vehicular traffic status, comprising:

a global positioning system receiver;

a transmitter for sending a transmitted message;

a receiver for receiving a received message containing a vehicle location, a vehicle speed, a vehicle direction, a vehicle type, a time, and a date;

a display unit presenting traffic status information; and a processor in communication with said global positioning system receiver, said transmitter, said receiver, and said display unit, said processor programmed to execute a process including receiving said received message, repeating said received message, transmitting said transmitted message, reporting vehicle data through a vehicle message containing a vehicle location, a vehicle speed, a vehicle direction, a vehicle type, a time, and a date, and displaying traffic status information by building a map image, scanning a database, classifying and accumulating traffic data, and generating said traffic status information as a composite map image, said process of reporting vehicle data through a vehicle message including acquiring said vehicle data, determining a road from a position determining device, determining whether a location and a time are sufficiently different from a previous location and a previous time to generate said vehicle message, generating said vehicle message to be transmitted, and communicating with said process for transmitting said transmitted message wherein said transmitted message is said vehicle message.

17. The mobile traffic unit of claim 16 wherein said process of receiving said received message includes determining whether said received message has already been received, storing said received message, and communicating with said process for repeating said received message.

18. The mobile traffic unit of claim 16 wherein said process of repeating said received message includes determining if said received message is stale, determining if a repetition count exceeds a maximum packet repetition count, generating a random number and a local traffic RF density, and comparing the results to determine if said received message is to be repeated.

19. The mobile traffic unit of claim 16 wherein said process of transmitting said transmitted message includes determining if there is a clear channel and sending said transmitted message to said transmitter.

20. The mobile traffic unit of claim 16 wherein said process of reporting vehicle data through a vehicle message includes constructing a message containing said vehicle data and communicating with said process for transmitting said transmitted message wherein said transmitted message is said vehicle message.

21. A mobile traffic unit for reporting and monitoring vehicular traffic status, comprising:

a means for acquiring vehicle data;

a means for transmitting said vehicle data;

a means for receiving a received message from a plurality of other vehicles;

a means for repeating said received message from said plurality of other vehicles;

a means for displaying traffic status information; and a means for disabling said mobile traffic unit.

22. The mobile traffic unit of claim 21 further including a means for preventing self-incrimination.

23. At least one processor programmed to execute a process for reporting and monitoring vehicular traffic status, the process comprising:

receiving a received message containing a vehicle location, a vehicle speed, a vehicle direction, a vehicle type, a time, and a date;

repeating said received message;

transmitting a transmitted message;

reporting vehicle data through a vehicle message, said vehicle message including a vehicle location, a vehicle speed, a vehicle direction, a vehicle type, a repeat count, a uniclue originator identifier, a packet sequential identifier, a time, and a date; and displaying traffic status information.

24. The at least one processor of claim 23 wherein said vehicle message includes a vehicle location, a vehicle speed, a vehicle direction, a vehicle type, a time, and a date.

25. The at least one processor of claim 23 wherein said vehicle message includes a vehicle speed and a vehicle location, said vehicle speed limited to a speed limit for said vehicle location.

26. The at least one processor of claim 23 wherein said process of receiving said received message includes determining whether said received message has already been received, storing said received message, and communicating with said process for repeating said received message.

27. The at least one processor of claim 23 wherein said process of repeating said received message includes determining if said received message is stale, determining if a repetition count exceeds a maximum packet repetition count, generating a random number and a local traffic RF density, and comparing the results to determine if said received message is to be repeated.

28. The at least one processor of claim 23 wherein said process of transmitting said transmitted message includes determining if there is a clear channel and sending said transmitted message to said transmitter.

29. The at least one processor of claim 23 wherein said process of reporting vehicle data through a vehicle message includes constructing a message containing said vehicle data and communicating with said process for transmitting said transmitted message wherein said transmitted message is said vehicle message.

30. The at least one processor of claim 23 wherein said process of reporting vehicle data through a vehicle message includes acquiring vehicle data, determining a road from a position determining device, determining whether a location and a time are sufficiently different from a previous location and a previous time to generate said vehicle message, generating said vehicle message to be transmitted, and communicating with said process for transmitting said transmitted message wherein said transmitted message is said vehicle message.

31. The at least one processor of claim 23 wherein said process of displaying said traffic status information includes generating said traffic status information to be displayed and communicating said traffic status information to said display unit.

32. The at least one processor of claim 23 wherein said process of displaying said traffic status information includes building a map image, scanning a database, classifying and accumulating traffic data, and generating said traffic status information as a composite map image.

33. A computer readable media tangibly embodying a program of instructions executable by a computer to perform a method of reporting and monitoring vehicular traffic status, said method comprising:

receiving a received message containing a vehicle location, a vehicle speed, a vehicle direction, a vehicle type, a time, and a date;

repeating said received message;

transmitting a transmitted message;

reporting vehicle data through a vehicle message, said vehicle message including a vehicle location, a vehicle speed, a vehicle direction, a vehicle type, a repeat count, a unique originator identifier, a packet sequential identifier, a time, and a date; and displaying traffic status information.

34. The method of claim 33 wherein said vehicle message includes a vehicle location, a vehicle speed, a vehicle direction, a vehicle type, a time, and a date.

35. The method of claim 33 wherein said vehicle message includes a vehicle location and a vehicle speed, said vehicle speed limited to a speed limit for said vehicle location.

36. The method of claim 33 wherein said process of receiving said received message includes determining whether said received message has already been received, storing said received message, and communicating with said process for repeating said received message.

37. The method of claim 33 wherein said process of repeating said received message includes determining if said received message is stale, determining if a repetition count exceeds a maximum packet repetition count, generating a random number and a local traffic RF density, and comparing the results to determine if said received message is to be repeated.

38. The method of claim 33 wherein said process of transmitting said transmitted message includes determining if there is a clear channel and sending said transmitted message to said transmitter.

39. The method of claim 33 wherein said process of reporting vehicle data through a vehicle message includes constructing a message containing said vehicle data and communicating with said process for transmitting said transmitted message wherein said transmitted message is said vehicle message.

40. The method of claim 33 wherein said process of reporting vehicle data through a vehicle message includes acquiring vehicle data, determining a road from a position determining device, determining whether a location and a time are sufficiently different from a previous location and a previous time to generate said vehicle message, generating said vehicle message to be transmitted, and communicating with said process for transmitting said transmitted message wherein said transmitted message is said vehicle message.

41. The method of claim 33 wherein said process of displaying said traffic status information includes generating said traffic status information to be displayed and communicating said traffic status information to said display unit.

42. The method of claim 33 wherein said process of displaying said traffic status information includes building a map image, scanning a database, classifying and accumulating traffic data, and generating said traffic status information as a composite map image.

* * * * *